US005566648A

United States Patent [19]

Fenn et al.

[11] Patent Number: 5,566,648

[45] Date of Patent: Oct. 22, 1996

[54] HEAT EXCHANGER

[75] Inventors: Gordon W. Fenn, Brevard, N.C.; Young M. Ryoo, Ansan, Rep. of Korea

[73] Assignee: Frontier, Inc., Ann Arbor, Mich.

[21] Appl. No.: 482,831

[22] Filed: Jun. 7, 1995

[30] Foreign Application Priority Data

Jan. 23, 1995 [KR] Rep. of Korea ..... 95-914

[51] Int. Cl.[6] ..... F22B 23/06

[52] U.S. Cl. ..... 122/367.3; 122/19; 122/161; 122/250 R; 126/350 R

[58] Field of Search ..... 122/367.1, 367.2, 122/367.3, 19, 18, 4 D, 6 A, 248, 250 R; 126/350 R, 351; 237/8 D

[56] References Cited

U.S. PATENT DOCUMENTS 4,550,689 11/1985 Wolter ..... 126/351

4,679,528 7/1987 Krans et al. ..... 122/367.3

5,216,981 6/1993 Solomon et al. ..... 122/367.3

5,233,970 8/1993 Harris ..... 126/350 R

*Primary Examiner*—James C. Yeung

*Attorney, Agent, or Firm*—George L. Boller

[57] ABSTRACT

A heat exchanger is disclosed including an annular lower manifold to which a cold-water intake through which cold water comes is connected; an annular upper manifold to which a hot-water exit through which hot water is discharged is connected; a plurality of coil-shaped heat exchange tubes connected between the lower and upper manifolds; an inner liner for embracing the plurality of coil-shaped heat exchange tubes on the inner surface thereof; and an outer liner for embracing the plurality of coil-shaped heat exchange tubes on the outer surface thereof, the inner and outer liners forming a path of burned gas.

2 Claims, 2 Drawing Sheets

HEAT EXCHANGER

BACKGROUND OF THE INVENTION

The present invention relates to a heat exchanger for use in a gas quick water heater, boiler, and the like, and more particularly, to a heat exchanger for a gas quick water heater in which water is heated in an indirect heating method for not exposing the exchanger to a high-temperature flame burned in a burner, and in which cold water passes through a plurality of coil-shaped heat exchange tubes to thereby greatly enhance thermal efficiency.

A heat exchanger used in a conventional gas quick water heater, boiler, and the like is installed above a burner, and directly exposed to a high-temperature flame therefrom. In the heat exchanger, a plurality of thermal conduction fins having a high thermal conductivity are attached to the surface of a pipe through which cold water passes, increasing thermal efficiency.

FIG. 1 is a schematic view of a general gas quick water heater. In FIG. 1, cold water supplied through a water supply pipe 1 passes through a heat exchange tube 2, and is then discharged through an outflow pipe 4. Passing through heat exchange tube 2, the cold water is heated directly by a burner 3 installed therebelow. Heat exchange tube 2 is manufactured of copper having an excellent thermal conductivity. Thermal conduction fins 5 are also made of copper, having an excellent thermal conductivity.

Such a directing heating method involves several drawbacks. Since heat exchange tube 2 is exposed to a high-temperature flame above about 750° C., harmful components such as combustion oxides contained in burned gases are adsorbed to thermal conduction fins 5 and heat exchange tube 2. Due to the high-temperature heating, thermal conduction fins 5 and heat exchange tube 2 are corroded to shorten their lives. Since the heat exchanger is expensive, exchanging it causes a lot of cost, increasing the consumer's economic burden. In attaching thermal conduction fins 5 to heat exchange tube 2, there is used lead so as to plug a gap therebetween and thereby prevent rocking therebetween. This increases thermal conductivity rate. As well-known in the art, lead is harmful to create trouble to workers and contaminate environment.

SUMMARY OF THE INVENTION

Therefore, in order to solve such problems, it is an object of the present invention to provide a heat exchanger, which is designed to be heated in an indirect heating method so as not to be corroded due to a high temperature, which can be used for a long time, and which can produce a sufficient amount of hot water even though it is a gas quick water heater.

It is another object of the present invention to provide a heat exchanger in which, without thermal conduction fins being used and lead dipping being performed, a plurality of coil-shaped heat exchange tubes are used to increase a thermal conduction area and therefore thermal efficiency.

To accomplish the above objects of the present invention, there is provided a heat exchanger comprising: an annular lower manifold to which a cold-water intake through which cold water comes is connected; an annular upper manifold to which a hot-water exit through which hot water is discharged is connected; a plurality of coil-shaped heat exchange tubes connected between the lower and upper manifolds; a baffle plates installed at the center portion of said coil-shaped heat exchange tubes; an inner liner for embracing the plurality of coil-shaped heat exchange tubes on the inner surface thereof; and an outer liner for embracing the plurality of coil-shaped heat exchange tubes on the outer surface thereof, the inner and outer liners forming a path of burned gas.

BRIEF DESCRIPTION OF THE ATTACHED DRAWINGS

DETAILED DESCRIPTION OF THE INVENTION

Hereinafter, a preferred embodiment of the present invention will be described with reference to the attached drawings.

Figure 2:
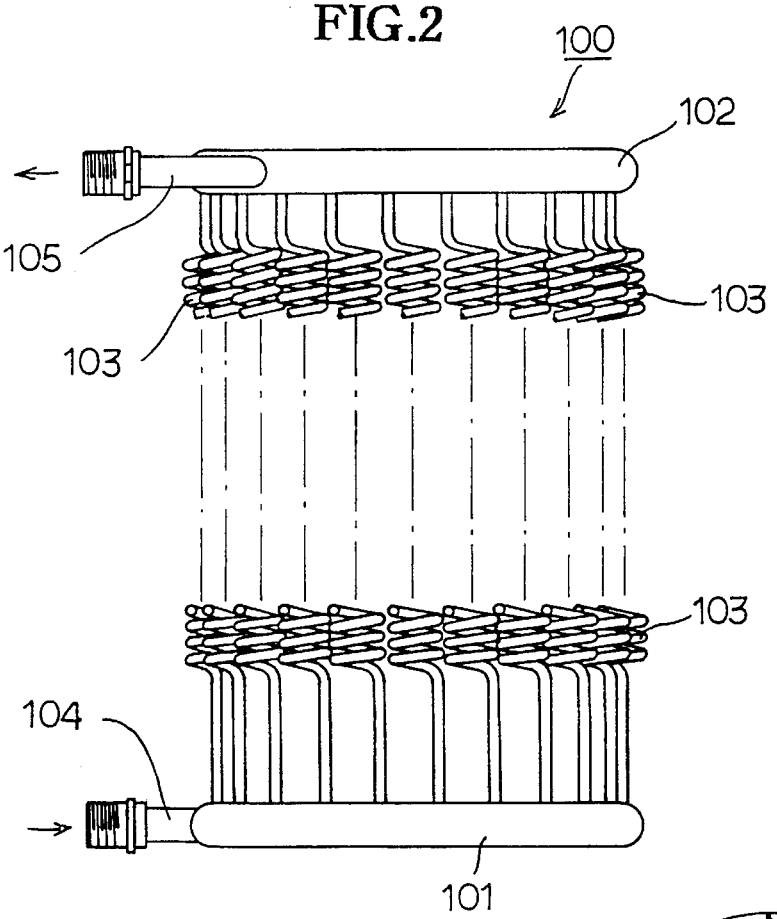
FIG. 2 is a side view of upper and lower manifolds and heat exchange tubes of a heat exchanger for a gas quick water heater of the present invention.
Figure 3:
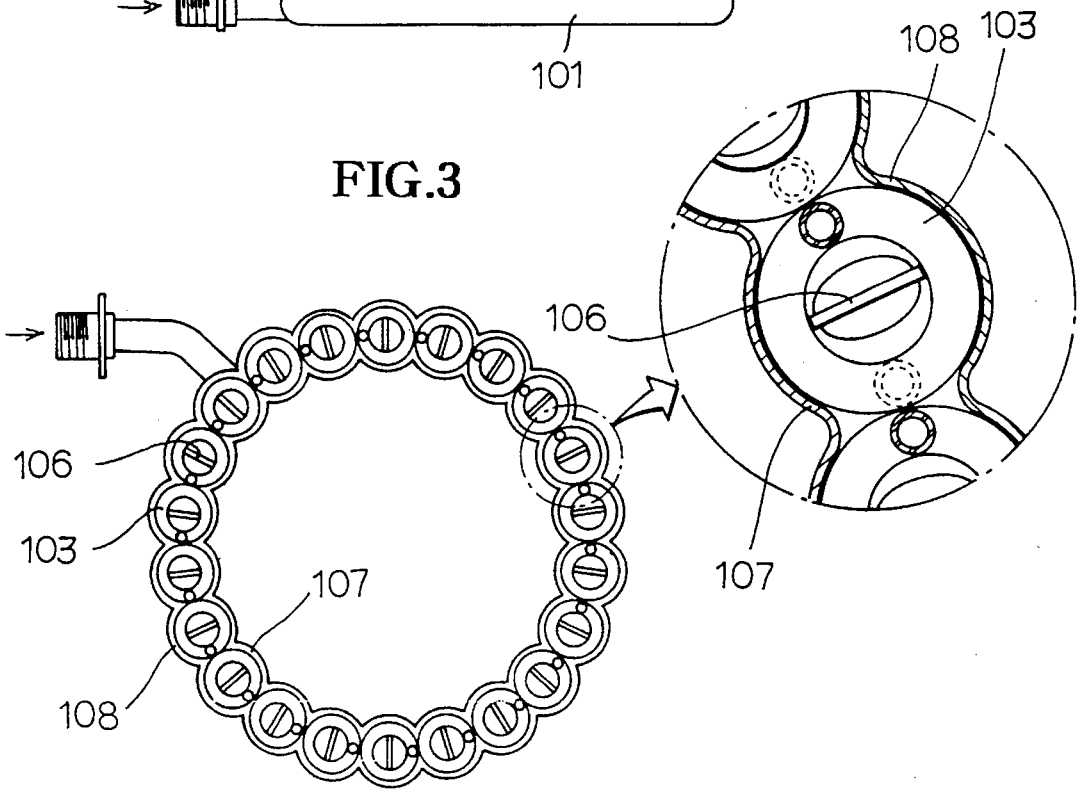
FIG. 3 is a plan sectional view of the heat exchanger for gas quick water heater of the present invention.

A heat exchanger 100 of the present invention, as shown in FIGS. 2 and 3, comprises a lower manifold 101, a upper manifold 102, a plurality of coil-shaped heat exchange tubes 103 connected between lower and upper manifolds 101 and 102, an inner liner 107 embracing the plurality of coil-shaped heat exchange tubes 103 on the inner surface thereof, and an outer liner 108 embracing the plurality of coil-shaped heat exchange tubes 103 on the outer surface thereof. Baffle plates 106 are perpendicularly installed at the center portion of coil-shaped heat exchange tubes 103.

Lower manifold 101 is an annular pipe to which a cold-water intake 104 through which cold water comes is connected. Upper manifold 102 is an annular pipe to which a hot-water exit 105 through which hot water goes is connected. The upper portion of coil-shaped heat exchange tubes 103 communicates with upper manifold 102 and the lower portion thereof does with lower manifold 101, forming a path of water.

Coil-shaped heat exchange tubes 103 are installed along annular lower and upper manifolds 101 and 102. The heat exchange tubes are disposed to be adjacent to each other.

Figure 1:
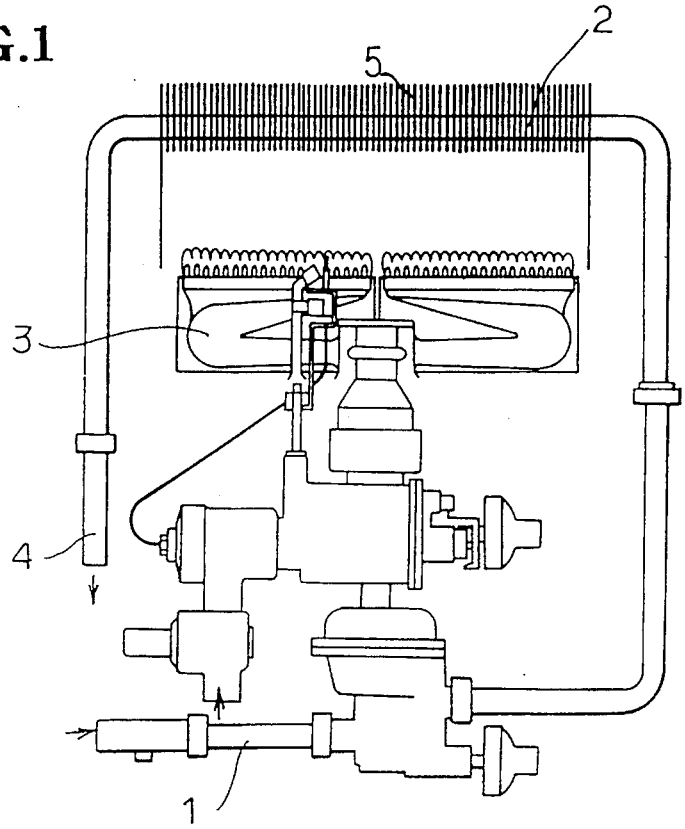
FIG.1 PRIOR ART
FIG. 1 is a schematic view of a conventional gas quick water heater.
Figure 4:
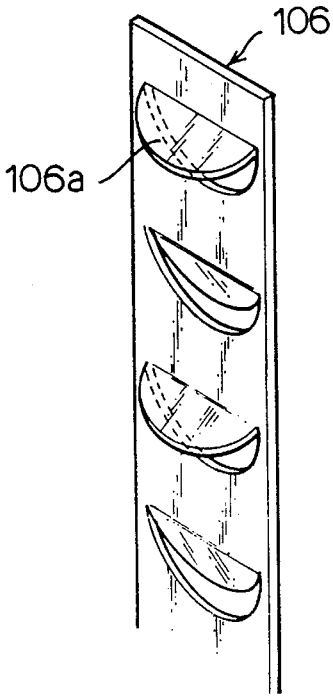
FIG. 4 is a perspective view of a baffle plate which is installed in the coil-shaped tubes of the heat exchanger of the present invention.

Referring to FIG. 4, baffle plate 106 is a ribbon-shaped metal plate in which baffles 106a are formed in either direction of the sides.

As shown in FIG. 3, in the heat exchanger of the present invention, inner and outer liners 107 and 108 for embracing the heat exchange tubes are provided on the inner and outer surfaces of the plurality of coil-shaped heat exchange tubes 103. The inner and outer liners 107 and 108 form a path through which high-temperature burned gas moves.

The heat exchanger of the present invention operates as below.

Cold water comes into lower manifold 101 through cold-water intake 104, and moves to upper manifold 102 through the plurality of coil-shaped heat exchange tubes 103. The hot water is discharged through hot-water exit 105. Since heat exchange tubes 103 are coil-shaped, water flows slowly.

High-temperature burned gas generated from a burner comes through the upper portion of the path of burned gas formed by inner and outer liners 107 and 108, and is discharged through the lower portion thereof. Since baffle plate 106 is provided at the center of heat exchange tubes 103, the burned gas flows slowly.

Heat exchange is carried out between the water flowing inside heat exchange tubes 103 and the burned gas flowing outside heat exchange tubes 103. Since the water and burned gas flow slowly, a heat exchange time is lengthened to greatly increase thermal efficiency.

Heat exchanger 100 for gas quick water heater of the present invention is heated indirectly not directly by the burner, preventing corrosion due to high temperature and harmful components such as combustion oxides. This sharply increases its life.

Despite the indirect heating method, the present invention has a sharply increased thermal efficiency, obtaining high-temperature hot water.

What is claimed is:

1. A heat exchanger having an imaginary longitudinal axis and comprising:

an annular lower manifold which is disposed about such axis and to which a cold-water intake through which cold water comes is connected;

an annular upper manifold which is disposed about such axis and to which a hot-water exit through which hot water is discharged is connected;

a plurality of axially extending, coil-shaped heat exchange tubes connected between said lower and upper manifolds, said plurality of coil-shaped heat exchange tubes presenting radially inwardly facing surface portions toward such axis and radially outwardly facing surface portions away from such axis;

an inner liner for embracing said radially inwardly facing surface portions of said plurality of coil-shaped heat exchange tubes; and an outer liner for embracing said radially outwardly facing surface portions of said plurality of coil-shaped heat exchange tubes, said inner and outer liners forming a path for burned gas.

2. A heat exchanger as claimed in claim 1, wherein baffle plates for delaying the flow of burned gas are perpendicularly provided at the center portion of said coil-shaped heat exchange tubes.

* * * * *